US007465240B2

(12) United States Patent
Frame

(10) Patent No.: US 7,465,240 B2
(45) **Date of Patent: *Dec. 16, 2008**

(54) GOLF CLUB HEAD

(75) Inventor: Nick Frame, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/893,152

(22) Filed: Aug. 14, 2007

(65) Prior Publication Data

US 2008/0045352 A1 Feb. 21, 2008

Related U.S. Application Data

(63) Continuation of application No. 11/051,161, filed on Feb. 3, 2005, now Pat. No. 7,278,926.

(51) Int. Cl.
*A63B 53/04* (2006.01)

(52) U.S. Cl. ..... 473/329; 473/331; 473/340; 473/342; 473/409

(58) Field of Classification Search ..... 473/324–350, 473/409

See application file for complete search history.

(56) References Cited

U.S. PATENT DOCUMENTS

| | | | | |
|---|---|---|---|---|
| 732,137 | A | | 6/1903 | Taylor |
| D63,284 | S | | 11/1923 | Challis |
| 4,529,203 | A | | 7/1985 | Ribaudo |
| 4,681,322 | A | | 7/1987 | Straza et al. |
| 4,964,641 | A | | 10/1990 | Miesch et al. |
| 5,348,301 | A | | 9/1994 | Ma |
| 5,531,439 | A | * | 7/1996 | Azzarella ..... 473/331 |
| 5,542,675 | A | | 8/1996 | Micciche et al. |
| 5,595,547 | A | | 1/1997 | Lekavich |
| 5,618,239 | A | | 4/1997 | Rife |
| 5,620,381 | A | | 4/1997 | Spalding |
| 5,688,190 | A | | 11/1997 | Rowland et al. |
| 5,690,561 | A | | 11/1997 | Rowland et al. |
| 5,709,616 | A | | 1/1998 | Rife |
| 5,807,190 | A | | 9/1998 | Krumme et al. |
| 5,899,819 | A | | 5/1999 | Mount et al. |
| 6,007,434 | A | | 12/1999 | Baker et al. |

(Continued)

OTHER PUBLICATIONS

Office Action from the United States Patent & Trademark Office in U.S. Appl. No. 11/051,161, dated Nov. 20, 2006.

(Continued)

*Primary Examiner*—Sebastiano Passaniti
(74) *Attorney, Agent, or Firm*—Klarquist Sparkman, LLP

(57) ABSTRACT

The present disclosure provides a putter head that has a plurality of deflectable beams or projections for striking a golf ball. Upon impact with the ball, the beams deflect and rebound to impart topspin on the ball, thereby resulting in forward rotation of the ball shortly after impact. In certain embodiments, the striking surface of the putter is comprised of a plurality of generally parallel, vertically spaced, deflectable beams extending horizontally across a front surface of the putter. Each beam extends downwardly from a fixed end to a free end that can contact the ball. In one specific implementation, the beams can be formed directly in the front surface of the putter head. In another implementation, the beams are formed in an insert that is mounted to the front surface of the putter head.

24 Claims, 4 Drawing Sheets

U.S. PATENT DOCUMENTS

| | | | |
|---|---|---|---|
| 6,224,497 | B1 | 5/2001 | Antonious |
| 6,257,994 | B1 | 7/2001 | Antonious |
| 6,277,033 | B1 | 8/2001 | Krumme et al. |
| 6,398,665 | B1 | 6/2002 | Antonious |
| 6,551,200 | B1 | 4/2003 | Golden et al. |
| 6,554,721 | B1 | 4/2003 | Woodward et al. |
| D478,142 | S | 8/2003 | Toulon et al. |
| 6,616,547 | B2 | 9/2003 | Vincent et al. |
| 6,648,772 | B2 | 11/2003 | Vincent et al. |
| D488,200 | S | 4/2004 | Olsavsky et al. |
| 6,719,644 | B2 | 4/2004 | Beach |
| 6,743,114 | B2 | 6/2004 | Best |
| 6,773,360 | B2 | 8/2004 | Willett et al. |
| 6,849,004 | B2 | 2/2005 | Lindsay |
| 2002/0042306 | A1 | 4/2002 | Chappell |
| 2003/0027659 | A1 | 2/2003 | Brown |
| 2004/0038746 | A1 | 2/2004 | Wahl et al. |
| 2005/0009623 | A1 | 1/2005 | Dickinson |
| 2005/0054461 | A1 | 3/2005 | Pakarnseree et al. |
| 2005/0075193 | A1 | 4/2005 | Otoguro |
| 2005/0255930 | A1 | 11/2005 | Johnson |
| 2006/0154746 | A1 | 7/2006 | Hagood et al. |
| 2006/0189409 | A1 | 8/2006 | Krumme |

OTHER PUBLICATIONS

Office Action from the United States Patent & Trademark Office in U.S. Appl. No. 11/051,161, dated May 17, 2007.

Notice of Allowance from the United States Patent & Trademark Office in U.S. Appl. No. 11/051,161, dated Jul. 3, 2007.

* cited by examiner

18
$W_i$
$T_i$
H
28
30
42
48
100
102
104
106
108
110
112
114

GOLF CLUB HEAD

CROSS-REFERENCE TO RELATED APPLICATION

The present application is a continuation of U.S. application Ser. No. 11/051,161, filed Feb. 3, 2005, now U.S. Pat. No. 7,278,926 which is incorporated herein by reference.

FIELD

The present disclosure concerns embodiments of a golf club head, and in particular, a head for a golf putter.

BACKGROUND

Most golf putters are provided with a smooth ball-striking face, with greater or lesser degree of loft in order to control the distance and direction that a struck golf ball travels. Generally, a golf ball struck by a lofted putter initially travels slightly upwards while spinning backwards, which causes the golf ball to skid or slide across the putting surface for a short distance after impact. Friction between the ball and the putting surface results in a forward moment opposing the backspin which eventually imparts a forward roll to the ball. When a golf ball is rolling forwards rather than skidding or sliding over the putting surface, the ball is less influenced by surface irregularities and the rotational inertia of the ball will cause it to have more of a tendency to continue in the true direction of the putting stroke. Thus, it is desirable to get a ball "rolling" as early after impact as possible.

Various attempts have been made to provide an improved putter that aids in imparting forward roll or topspin to a golf ball. For example, it is known to provide the front face of a putter with upwardly angled, V-shaped projections that are elongated in the direction from the heel to the toe of the putter. The sharp edges of the projections purportedly enhance friction between the putter face and the ball, creating a gripping effect as the putter comes in contact with the ball, which promotes the transfer of topspin to the ball.

There is also a demand for putters that transfer sufficient momentum to the golf ball while providing an improved "feel" for the player. The "feel" of a club generally relates to the sensory feedback that the player receives when the club head strikes the golf ball. In other words, an improved "feel" gives the player a greater sense that the putter head is an extension of the player's hands and the perception that the player is more able to guide the ball along the desired path to the hole. The feel of the putter head is primarily a function of the spring constant (k) of the putter face. The spring constant is generally determined by the Young's modulus of the material, as well as the contact area (i.e., the amount of surface area on the putter face that actually contacts the ball during the putting stroke).

When projections have been used in connection with putters, the projections unfortunately have lacked the proper structure to effectively improve the feel and control of the putter. For example, the projections typically have sharp tips, which collectively form the contact face of the putter. Because the contact area is relatively small, the ball trajectory tends to be less controllable. The lack of sufficient contact area can also result in inconsistencies between putting strokes, since the impact of the club on the ball varies significantly depending upon the location and the angle of the putter face relative to the ball. Additionally, the sharp ends of the projections increase the friction between the club face and the ball, which can result in the club conferring too much spin to the ball so that ball trajectories can be unusual and unpredictable.

To improve the feel of the putter, golf club manufacturers have designed putter heads with soft plastic inserts that are mounted on the face of the putter head. The plastic inserts are mainly directed toward improving the feel of the putter through the use of low modulus material. The plastic inserts generally have a low Young's modulus to improve the feel of the putter, but unfortunately also present certain disadvantages. In particular, plastic inserts have a tendency to lower the sound when the club impacts the ball which causes a lack of acoustic feedback to the player. Additionally, such inserts do not promote the transfer of topspin to the ball to improve control.

Accordingly, there is a need for a golf putter that promotes the transfer of topspin to the ball to improve accuracy while providing improved feel.

SUMMARY

To such ends, the present disclosure provides a putter head with a front surface having a plurality of deflectable beams or projections formed therein. The end surfaces of the beams collectively define a compliant striking face for striking a golf ball. Upon impact with the ball, the beams deflect and rebound to impart topspin on the ball, thereby resulting in earlier forward rotation of the ball after impact. Early forward rotation of the ball helps to minimize or eliminate the adverse effects of backspin induced skipping and sliding, such as the tendency of the ball to follow the grain of the putting green or to be knocked off line by other surface irregularities in the putting green.

Additionally, in particular embodiments, the beams are effective to impart a launch angle to the ball. The deflection of the beams also increases dwell time of the ball on the putter head, which improves the feel of the putter head when striking a golf ball.

In certain embodiments, the striking surface of the putter is comprised of a plurality of generally parallel, vertically spaced, deflectable beams extending horizontally across a front surface of the putter head. Each beam extends downwardly from a fixed end to a free end that can contact the ball. Upon impact with the ball, the beams deflect downwardly and inwardly, and then rebound upwardly and outwardly against the ball, thereby imparting topspin and providing an initial lift to the ball.

In one specific implementation, the beams can be formed directly in the front surface of the putter head. In another implementation, the beams are formed in an insert that is mounted to the front surface of the putter head. Desirably, the insert is mounted in a recess formed in the front surface. The insert can be permanently attached to the putter head, or alternatively, the insert can be removably attached to the putter head such that the insert may be replaced with another insert having different performance characteristics. In this manner, a golfer can select an insert that best suits the golfer's level of play or particular course conditions.

In particular embodiments, each beam has substantially parallel, opposed upper and lower surfaces and a substantially flat end surface. The end surfaces of the beams collectively define a striking face for contacting the ball. Each beam desirably has a substantially constant thickness measured between the upper and lower surfaces, although in other embodiments the beams can be tapered.

The foregoing and other features and advantages of the invention will become more apparent from the following detailed description of several embodiments, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises."

Figure 1:
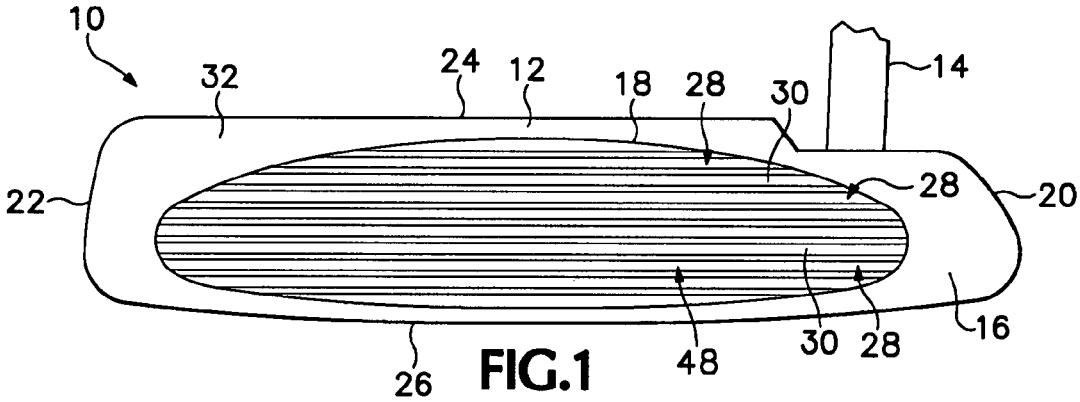
FIG. 1 is a front elevation view of a putter head having an insert mounted to the front surface of the head, according to one embodiment.
Figure 2:
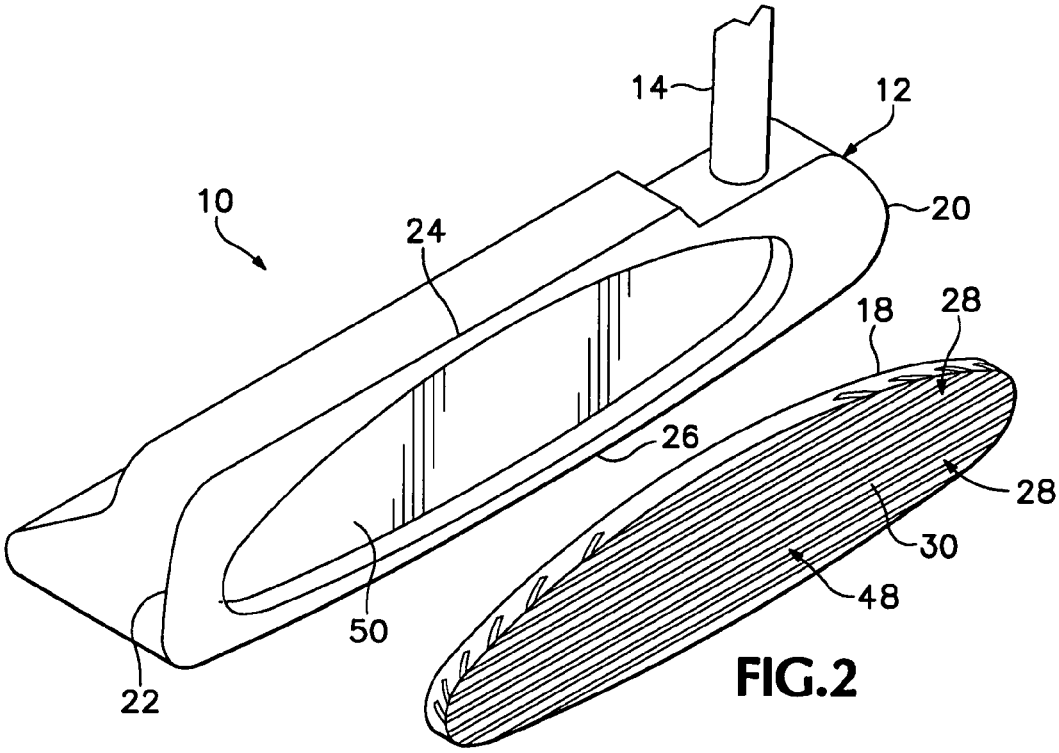
FIG. 2 is a perspective, exploded view of the putter head of FIG. 1.
Figures 3, 4, 6, 7, 8:
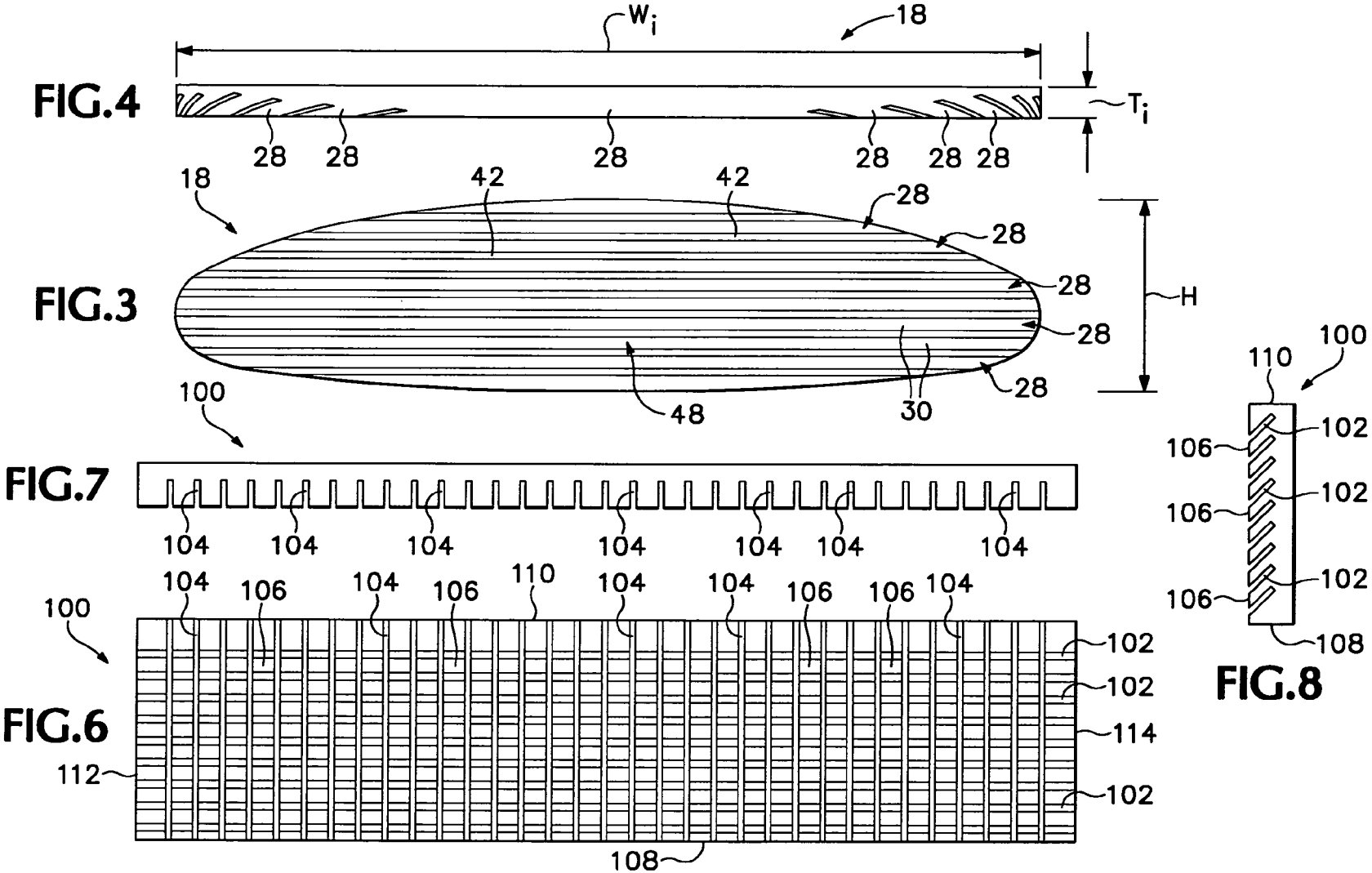
FIG. 3 is a front elevation view of the insert of FIG. 1, shown removed from the putter head.
FIG. 4 is a plan view showing the top edge of the insert shown in FIG. 3.
FIG. 6 is a front elevation view of an insert that can be mounted to the front surface of a putter head, according to another embodiment.
FIG. 7 is a plan view showing the top edge of the insert shown in FIG. 6.
FIG. 8 is an elevation view showing the side edge of the insert shown in FIG. 6.

Referring first to FIGS. 1-3, there is shown a putter head 10, according to one embodiment, which is used to putt a ball (not shown) toward a hole (not shown). The putter head 10 generally comprises an elongated main body 12 having an upwardly extending neck 14. The neck 14 allows the putter head 10 to be connected to a golf club shaft (not shown) in a conventional manner.

Figure 11:
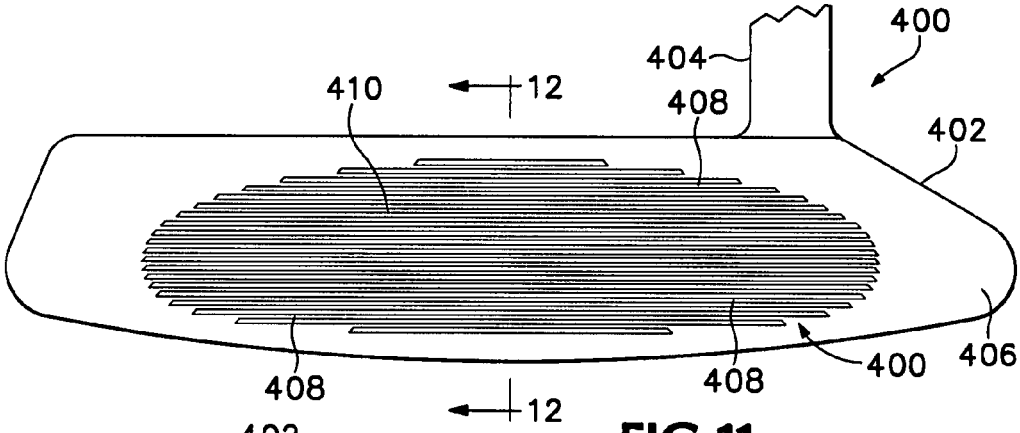
FIG. 11 is a front elevation view of a putter head having a plurality of beams formed directly in the front surface of the putter head, according to one embodiment.
Figure 12:
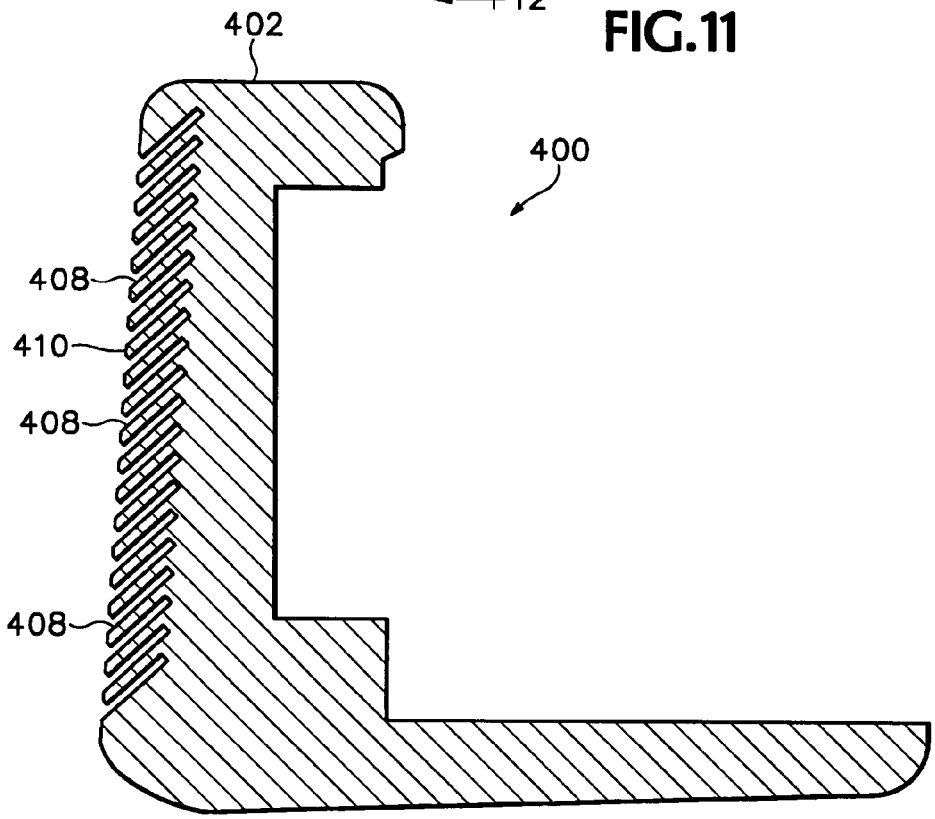
FIG. 12 is cross-sectional view of the putter head of FIG. 11 taken along line 12-12 of FIG. 11.

The main body 12 in the illustrated configuration has a front surface 16 that defines a heel 20, a toe 22, a top edge 24, and a bottom edge 26. An insert 18 desirably is sized and shaped to fit within a recess 50 (FIG. 2) in the front surface 16. The illustrated insert 18 comprises a plate-like structure defining a plurality of generally parallel, vertically spaced, deflectable beams, or projections, 28 extending horizontally across the front surface 16 between the heel 20 and the toe 22. The end surfaces 30 of the beams 28 collectively define a compliant striking face 48 for contacting the ball. In an alternative embodiment, the beams 28 can be formed directly in the main body 12 (such as shown in FIGS. 11 and 12), rather than in the insert 18. Upon impact with the ball, the beams 28 deflect and rebound to impart topspin and provide an initial lift to the ball, as further described below.

The insert 18 desirably is sized such that the end surfaces 30 of the beams 28 are substantially flush with and parallel to a peripheral portion 32 of the front surface 16 surrounding the insert 18. In alternative embodiments, however, the beams 28 can be raised with respect to the peripheral portion 32, or alternatively, the beams 28 can be recessed inwardly from the peripheral portion 32. The insert 18 can be attached to the main body 12 using any suitable techniques or mechanisms, such as mechanical bonding, adhesive bonding, welding, brazing, mechanical fasteners, etc.

Alternatively, the insert 18 can be removably mounted to the main body 12, such as with screws or via a frictional fit between the insert 18 and the surrounding recess. Thus, in this alternative embodiment, the putter can be adapted to accept different inserts for different golfers and/or different course conditions.

The insert 18 desirably has a shape that conforms to the desired general strike location of a ball with the front surface 16 of the putter head 10. In the illustrated embodiment, the insert 18 is generally elliptical, but can also comprise any other geometric shape, such as a rectangle (as shown in FIG. 6), square, circle, trapezoid, or combinations thereof. Also, although the peripheral portion 32 of the front surface 16 is shown as completely surrounding the insert 18, this is not a requirement. For example, in one embodiment, the insert 18 can extend from the top edge 24 to the bottom edge 26 of the front surface 16. In another embodiment, the insert can extend from the heel 20 to the toe 22 across the entire width of the front surface 16.

The insert 18 and the main body 12 may be formed either from a metal/metal alloy, polymer, composite, ceramic, or various combinations thereof. Generally, an insert 18 formed from a metallic material provides the putter head 10 with a more solid feel during impact with a golf ball, whereas an insert 18 formed from a polymeric material, such as plastic, provides a softer feel than a metallic insert. The insert 18 may be manufactured of the same material as the main body 12 or it may be manufactured of a different material.

Some examples of metals and metal alloys that can be used to form the insert 18 or the main body 12 include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the insert 18 or the main body 12 include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the insert 18 or the main body 12 include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®).

Some examples of ceramics that can be used to form the insert 18 or the main body 12 include, without limitation, oxides (e.g., titanium oxide, aluminum oxide, magnesium oxide, and silicon oxide), carbides (e.g., titanium carbide, tungsten carbide, silicon carbide, and boron carbide), and nitrides (e.g., silicon nitride).

The insert 18 can be formed using conventional manufacturing techniques, such as, for example, die casting, injection molding, extrusion, forging, saw cutting, EDM (electrical discharge machining), milling, etching, etc. Any of the foregoing manufacturing techniques also can be used if the beams are formed directly in the front face 16 of the main body 12, rather than in an insert. The insert 18 and/or the main body 12 can be subjected to various surface treatment and/or coating processes, such as, for example, anodizing, nitriding, ion plating, PVD (physical vapor deposition), CVD (chemical vapor deposition), painting, powdercoating, electroplating, electroless plating, etc. to improve corrosion resistance, abrasion resistance, hardness, or other characteristics of the components.

Figure 5:
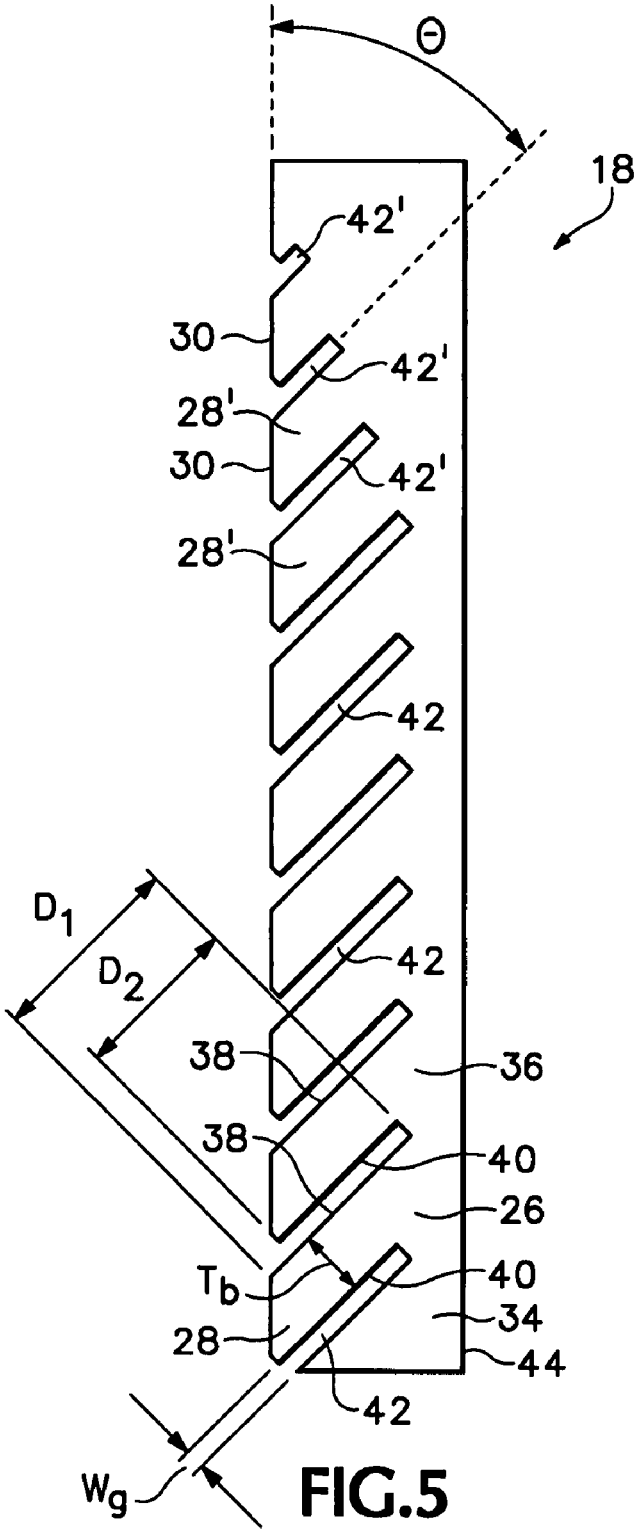
FIG. 5 is an enlarged, elevation view showing the side edge of the insert shown in FIG. 3.

As best shown in FIG. 5, the beams 28 extend outwardly and downwardly from a base 34 of the insert 18 The end surfaces 30 of the beams 28 desirably are flat and co-planar with the peripheral portion 32 of the front surface 16. Each beam 28 has a fixed end 36 that is desirably integrally formed with the base 34. Each beam 28 in the illustrated configuration has a cross-sectional profile generally in the form of a parallelogram. Each beam 28 has an upper surface 38 spaced from a substantially parallel lower surface 40 defining a substantially constant beam thickness $T_b$ measured between the upper and lower surfaces 38, 40. The beams 28 can extend continuously between opposing points on the periphery of the insert 18, as shown in FIG. 3. In alternative embodiments, however, the insert 18 can be formed with one or more rows of horizontally spaced beams (e.g., beams 106 shown in FIGS. 6-8).

The upper surface 38 has a depth $D_1$ that preferably is slightly greater than the depth $D_2$ of the lower surface 40. A gap 42 is defined between the upper and lower surfaces 38, 40 of adjacent beams 28 Each gap 42 defines a substantially constant gap width $W_g$ measured between the upper and lower surfaces 38, 40 of adjacent beams 28 The depths $D_1$ and $D_2$ for each beam 28 in the illustrated embodiment are the same, except for the top three beams 28', which have depths that decrease progressively in the upward direction. This provides greater rigidity to the top three beams 28'. In some embodiments, the gap width $W_g$ of one or more gaps 42 may be varied depending on the orientation of the gaps 42 with respect to the center of the insert 18 For example, a gap 42 disposed at the center of the insert 18 may have a larger gap width $W_g$ than a gap 42 disposed towards the top and/or bottom of the insert 18.

In certain embodiments, one or more gaps 42 between adjacent beams 28 may extend to the rear surface 44 of insert 18, thereby forming one or more vertically spaced slots extending through the entire thickness $T_i$ of the insert 18. Such slots may extend across all or a portion of the width $W_i$ of the insert 18 and provide a maximum beam depth $D_1$ and/or $D_2$ for a particular insert thickness.

In certain embodiments, the beam upper surfaces 38 have a depth $D_1$ that is between approximately 1 and 3 mm; the beam lower surfaces 40 have a depth $D_2$ that is between approximately 0.8 and 2.8 mm; the beams 28 have a thickness $T_b$ that is between approximately 0.3 and 1.0 mm; and the gaps 42 have a gap width $W_g$ that is between approximately 0.1 and 0.4 mm. Of course, these specific dimensions (as well as other dimensions provided in the present specification) are given to illustrate the invention and not to limit it. The dimensions provided herein can be modified as needed in different applications or situations.

As shown in FIG. 3, the gaps 42 between adjacent beams 28 can extend across the entire width $W_i$ of the insert 18 In an alternative embodiment, the gaps 42 between adjacent beams 28 can extend less than the entire width $W_i$ of the insert 18, such that one or both toe/heel end portions of the beams 28 are fixed relative to a peripheral portion of the insert (such as insert 300 shown in FIG. 10 and further described below).

The insert 18 in the illustrated embodiment has nine beams 28, although in other embodiments the insert 18 can have greater or fewer number of beams 28 In certain embodiments, for example, the insert 18 can have eight to fifteen beams.

As shown in FIG. 5, when the putter head 10 is at address position, beams 28 project downwards toward a bottom portion of the main body 12 (FIG. 1) such that beams 28 define an acute angle θ extending between the beams 28 and a vertical axis (relative to a putting surface ground plane). In one embodiment, angle θ may be defined as the angle extending between an upper surface 38 of a beam 28 and a vertical axis. In an alternative embodiment, angle θ may be defined as the angle extending between a lower surface 40 of a beam 28 and a vertical axis.

In particular embodiments, the sum of angle θ and the loft angle of the putter is in the range of about 10 to 80 degrees, and more desirably about 30 to 60 degrees, and most desirably about 40 to 50 degrees, with 45 degrees being a specific example. In typical embodiments where the putter loft angle ranges from 3 to 5 degrees, angle θ is in the range of about 6 to 76 degrees, and more desirably about 26 to 56 degrees, and most desirably about 36 to 46 degrees, with 41 degrees being a specific example.

In an alternative embodiment where the insert rear surface 44 is substantially parallel to a striking face 48 collectively defined by the end surfaces 30 of the beams 28, each beam may define an acute angle extending between a beam and the rear surface 44 of the insert 18 In such an embodiment, the acute angle may be of the same magnitude as angle θ as defined above.

Upon contact with a ball, the beams 28 deflect inwardly and downwardly, and then recoil outwardly and upwardly, thereby imparting topspin and a launch angle to the ball. The frequency of oscillation (f) of a beam 28 can be estimated by the following equation:

$$f = \sqrt{\frac{E \cdot T_b^2 \cdot \lambda^4}{48 \cdot \pi^2 \cdot \rho \cdot D_2^4}}$$

where E is the Young's modulus of the beam material, λ is equal to 1.8751 for the fundamental mode of vibration, and ρ is the density of the beam material. In certain embodiments, the beams 28 have a frequency of oscillation in the range of about 3 kHz to about 300 kHz, and more desirably in the range of about 8 kHz to about 150 kHz, and most desirably in the range of about 12 kHz to about 95 kHz.

The beams 28 in certain embodiments are sufficiently resilient to deflect upon impact, but yet are stiff enough to be self-supporting; that is, the stiffness of the beams prevent a beam from contacting an adjacent beam upon deflection. In other embodiments, however, the beams 28 can be configured to contact each other upon deflection.

Additionally, the dimensions of the beams 28 can be varied to achieve different performance characteristics for different levels of play or different course conditions. For example, the effective spring constant of the beams 28 (i.e., the stiffness of the beams) can be decreased to increase the amount of forward roll imparted on the ball by increasing the depth of the beams, decreasing the beam thickness, and/or forming the beams 28 from a material having a lower modulus of elasticity.

In alternative embodiments, the cross-sectional profile of the beams 28 can define any of various geometric shapes. In one implementation, for example, the beams 28 can be tapered from their fixed ends 36 to their end surfaces 30. Alternatively, the beams 28 can be tapered from their end surfaces 30 to their fixed ends 36. Rather than having flat end surfaces 30, the beams 28 can have a generally V-shaped cross-sectional profile such that the beams 28 taper to a sharp outer edge for contacting the ball. In still another implementation, the beams 28 can have curved end surfaces for contacting the ball.

The thickness $T_b$ of one or more beams 28 can vary across the width of the beams. For example, the thickness $T_b$ of a beam 28 can be greatest at the heel 20 and toe 22 ends of the insert 18 and decrease moving toward the center, or alternatively, the thickness $T_b$ of a beam 28 can be greatest at the center of the insert 18 and decrease moving toward the heel 20 and toe 22 ends of the insert 18 Also, the thickness $T_b$ of one or more beams 28 can vary across the height H of the insert 18 For example, the thickness $T_b$ of beams 28 disposed at either or both of the top and bottom of the insert 18 may be greater than the thickness $T_b$ of beams 28 disposed at the center of the insert 18 Conversely, the thickness $T_b$ of beams 28 disposed at the center of the insert 18 may be greater than the thickness $T_b$ of beams 28 disposed at either or both of the top and bottom of the insert 18.

In alternative embodiments, the end surfaces 30 of the beams 28 and/or the peripheral portion 32 of the front surface 16 can have various surface textures for aesthetics, to increase the coefficient of friction of the striking face, or for other reasons. For example, a series of straight or arcuate parallel grooves can be formed in the end surfaces 30 and the peripheral portion 32.

In particular embodiments, the gaps 42 between the beams 28 can be filled with a compliant filler material to prevent debris, such as grass or dirt, from collecting in the gaps. The filler material desirably is compliant enough to allow for sufficient deflection of the beams.

Examples of suitable filler materials that can be used include, without limitation, viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available filler materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., NoViFlex™ Sylomer® from Pole Star Maritime Group, LLC, Isoplast® from The Dow Chemical Company, and Legetolex™ from Piqua Technologies, Inc.

Another group of suitable filler materials is low-density granular materials such as, without limitation, perlite; vermiculite; polyethylene beads; glass microspheres; expanded polystyrene; nylon flock; ceramics; polymeric elastomers; rubbers; dendritic particles; and mixtures thereof.

The putter head 10 is used to propel a golf ball toward a hole by striking the golf ball with the striking face 48 that is collectively formed by the end surfaces 30 of the beams 28 Desirably, the golfer aligns the putter head 10 such that the end surfaces 30 of the beams 28 are the only portion of the putter head 10 to contact the ball during the putting stroke. Upon impact with a ball, the beams 28 deflect downwardly and inwardly and then rebound upwardly and outwardly, thereby pushing on the ball periphery in the same direction. The rebound of the beams 28 applies a forward moment on the ball so as to cause forward rotation of the ball immediately or shortly after impact with the striking face 48. The early forward rotation of the ball helps to minimize or eliminate the adverse effects of backspin induced skipping and sliding, such as the tendency of the ball to follow the grain of the putting green or to be knocked off line by other surface irregularities in the putting green. Moreover, because the beams 28 deflect and rebound in a predictable fashion, the beams 28 improve the feel of the putter head 10 when striking a golf ball. Also, unlike typical conventional putter heads having projections to improve the feel of the putter head, control of the golf ball is not adversely affected. As discussed above, control of the ball actually is improved due the tendency of the beams to impart topspin and a launch angle to the ball.

FIGS. 6-8 show an insert 100 for a putter head, according to another embodiment. The insert 100 is generally rectangular, although it can have other geometric shapes. The insert 100 can be attached to a putter head, such as by mounting the insert in a recessed portion in the front face of the putter head, as described above. The insert 100 is formed with a plurality of horizontally extending, vertically spaced gaps, or cuts, 102 and a plurality of vertically extending, horizontally spaced gaps, or cuts, 104, which form a plurality of downwardly extending beams, or projections, 106.

While the horizontal gaps 102 are spaced uniformly moving from the bottom edge 108 to the top edge 110 of the insert 100 and the vertical gaps 102 are spaced uniformly moving from the toe edge 112 (the left edge in FIG. 6) to the heel edge 114 (the right edge in FIG. 6), this is not a requirement. Accordingly, the spacing of the horizontal gaps 102 and/or the vertical gaps 104 can be varied across the face of the insert 100, so as to achieve different beam stiffness at different sections of the insert 100. In addition, the insert 100 can be formed with vertical gaps 104 that extend only partially between the top and bottom edges 110, 108 of the insert.

Figure 9:
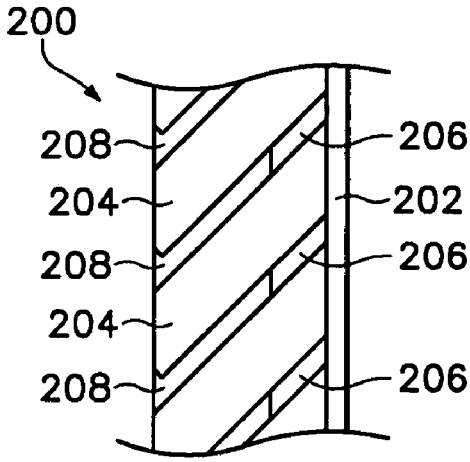
FIG. 9 is an enlarged, partial side elevation view of an insert, according to another embodiment.

FIG. 9 shows an insert 200, according to another embodiment. The illustrated insert 200 comprises a support 202 that can comprise a plate-like member and a plurality of beams 204 extending downwardly from the support 202. In particular embodiments, the beams 204 are separately formed and subsequently attached to the support 202 using suitable techniques or mechanisms, such as mechanical bonding, adhesive bonding, welding, brazing, mechanical fasteners, etc.

As shown, spacers 206 can be positioned between adjacent beams 204. The depth of the spacers 206 can be varied to alter the effective depth of the beams 204 (i.e., the portion of a beam 204 that is cantilevered with respect to an adjacent spacer 206). For example, increasing the depth of the spacers 206 decreases the effective depth of the beams 204 and therefore increases the stiffness of the beams. Similarly, the thickness of the spacers 206 can be varied to alter the gap width between adjacent beams 204. For example, increasing the thickness of the spacers 206 increases the gap width between adjacent beams 204. The support 202, the beams 204, and the spacers 206 can be made of any of various suitable materials, such as any of the metals, metal alloys, composites, polymers, or ceramics described above for the insert 18.

Additionally, the insert 200 can include optional compliant filler material 208 disposed between adjacent beams 204 to prevent debris from collecting in the gaps between adjacent beams. The filler material 208 can comprise any of the suitable filler materials described above for the insert 18.

Figure 10:
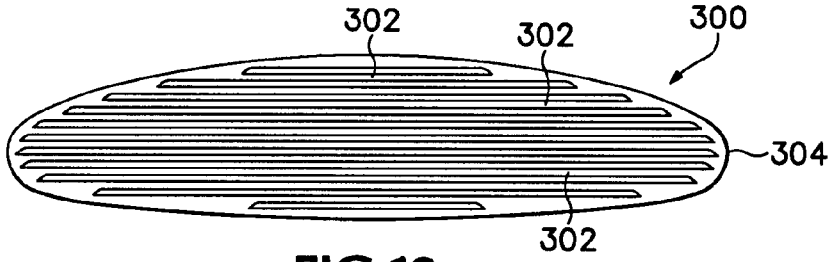
FIG. 10 is a front elevation view of another embodiment of an insert.

FIG. 10 shows an insert 300, according to yet another embodiment, that includes a plurality of beams 302. The insert 300 is similar to the insert 18 shown in FIGS. 1-5, with the exception that the beams 302 of the insert 300 do not extend across the entire width $W_i$ of the insert 300 and instead terminate at a peripheral portion 304 that surrounds the beams 302. In a modification of the insert 300, the peripheral portion 304 extends only partially around the beams 302.

FIGS. 11 and 12 show a putter head 400, according to another embodiment, that comprises a main body 402 having an upwardly extending neck 404. Unlike the putter head 10 shown in FIGS. 1 and 2, the putter head 400 includes a plurality of beams 408 formed directly in the front surface 406 of the main body 402. The end surfaces of the beams 408 collectively define a striking face 410 for contacting a ball. The overall shape of striking face 410 in the illustrated embodiment is similar to the shape of the insert 18 shown in FIGS. 1-5. However, this is not a requirement. Accordingly, the striking face 410 can have any of various shapes and can cover any portion of the front surface 406. Similarly, the beams 408 can have any of the various shapes or configurations described above for the beams 28.

EXAMPLES

Example 1

An insert 18 was constructed of ABS plastic with an overall width $W_i$ (FIG. 4), height H (FIG. 3), and thickness $T_i$ (FIG. 4) of about 85.16 mm, 18.59 mm, and 3.05 mm, respectively. The insert included ten beams 28. The beams had a depth $D_1$ of about 3.10 mm, a depth $D_2$ of about 2.62 mm, a thickness $T_b$ of about 0.89 mm, a gap width $W_g$ of about 0.30 mm, and were oriented at approximately a 45 degree angle with respect to a vertical axis relative to a putting surface ground plane.

Example 2

An insert 18 was constructed of 6061 anodized aluminum with an overall width $W_i$ (FIG. 4), height H (FIG. 3), and thickness $T_i$ (FIG. 4) of about 85.16 mm, 18.59 mm, and 3.05 mm, respectively. The insert included fifteen beams 28. The beams had a depth $D_1$ of about 3.10 mm, a depth $D_2$ of about 2.62 mm, a thickness $T_b$ of about 0.40 mm, a gap width $W_g$ of about 0.30 mm, and were oriented at approximately a 45 degree angle with respect to a vertical axis relative to a putting surface ground plane.

Example 3

An insert 18 was constructed of 6061 anodized aluminum with an overall width $W_i$ (FIG. 4), height H (FIG. 3), and thickness $T_i$ (FIG. 4) of about 85.16 mm, 18.59 mm, and 3.05 mm, respectively. The insert included twelve beams 28. The beams 28 had a depth $D_1$ of about 3.10 mm, a depth $D_2$ of about 2.62 mm, a thickness $T_b$ of about 0.68 mm, a gap width $W_g$ of about 0.30 mm, and were oriented at approximately a 45 degree angle with respect to a vertical axis relative to a putting surface ground plane.

Example 4

An insert 18 was constructed of 6061 anodized aluminum with an overall width $W_i$ (FIG. 4), height H (FIG. 3), and thickness $T_i$ (FIG. 4) of about 85.16 mm, 18.59 mm, and 3.05 mm, respectively. The insert included eleven beams 28. The beams 28 had a depth $D_1$ of about 3.10 mm, a depth $D_2$ of about 2.62 mm, a thickness $T_b$ of about 0.78 mm, a gap width $W_g$ of about 0.30 mm, and were oriented at approximately a 45 degree angle with respect to a vertical axis relative to a putting surface ground plane.

Example 5

An insert 18 was constructed of 6061 anodized aluminum with an overall width $W_i$ (FIG. 4), height H (FIG. 3), and thickness $T_i$ (FIG. 4) of about 85.16 mm, 18.59 mm, and 3.05 mm, respectively. The insert included ten beams 28. The beams had a depth $D_1$ of about 3.10 mm, a depth $D_2$ of about 2.62 mm, a thickness $T_b$ of about 0.89 mm, a gap width $W_g$ of about 0.30 mm, and were oriented at approximately a 45 degree angle with respect to a vertical axis relative to a putting surface ground plane.

Example 6

An insert 18 was constructed of 6061 anodized aluminum with an overall width $W_i$ (FIG. 4), height H (FIG. 3), and thickness $T_i$ (FIG. 4) of about 85.16 mm, 18.59 mm, and 3.05 mm, respectively. The insert included nine beams 28. The beams 28 had a depth $D_1$ of about 3.10 mm, a depth $D_2$ of about 2.62 mm, a thickness $T_b$ of about 1.03 mm, a gap width $W_g$ of about 0.30 mm, and were oriented at approximately a 45 degree angle with respect to a vertical axis relative to a putting surface ground plane.

Example 7

An insert 18 was constructed of 6061 anodized aluminum with an overall width $W_i$ (FIG. 4), height H (FIG. 3), and thickness $T_i$ (FIG. 4) of about 85.16 mm, 18.59 mm, and 3.05 mm, respectively. The insert included eight beams 28. The beams 28 had a depth $D_1$ of about 3.10 mm, a depth $D_2$ of about 2.62 mm, a thickness $T_b$ of about 1.18 mm, a gap width $W_g$ of about 0.30 mm, and were oriented at approximately a 45 degree angle with respect to a vertical axis relative to a putting surface ground plane.

Example 8

An insert 100 was constructed of 6061 anodized aluminum with an overall width $W_i$, height H, and thickness $T_i$ of about 86 mm, 20 mm, and 4 mm, respectively. The width of the horizontal gaps 102 (i.e., the spacing between beams 106 in the vertical direction) and the width of the vertical gaps 104 (i.e., the spacing between beams 106 in the horizontal direction) was about 0.5 mm. The beams 106 had a depth of about 4.2 mm, a thickness measured between the upper and lower surfaces of each beam 106 of about 1.4 mm, a width measured between the vertical sides of each beam 106 of about 2.0 mm, and were oriented at approximately a 45 degree angle with respect to a vertical axis relative to a putting surface ground plane.

Example 9

A putter head 400 was constructed of steel and included nineteen beams 408 formed in the front surface 406 of the putter head. The beams 408 had a depth $D_1$ of about 3.1 mm, a depth $D_2$ of about 2.62 mm, a thickness $T_b$ of about 0.40 mm, a gap width $W_g$ of about 0.30 mm, and were oriented at approximately a 45 degree angle with respect to a vertical axis relative to a putting surface ground plane.

The inserts and putter described above in examples 1, 2, 5, and 9 were used to putt a golf ball. The physical characteristics and the "net shift" forward spin (measured in rpm) and frequency of beam oscillation for each example are shown in Table 1 below. The "net shift" forward spin is the difference between the forward spin of a golf ball struck with a putter having a substantially planar steel striking surface and the forward spin of an identical golf ball struck with a similarly shaped putter having deflectable beams, as measured shortly after impact. The testing method included six golfers, ten putts per putter per golfer, and 14-foot putts on a level and substantially planar putting surface. An indoor artificial putting surface was used primarily for consistency and to eliminate environmental variances. The spin of the ball was measured using a video camera system, as known in the art.

TABLE 1

| Example | Material | Beam angle (θ) | Beam depth, mm ($D_2$) | Beam thickness, mm ($T_b$) | Gap width, mm ($W_g$) | Net shift forward spin, rpm | Frequency (kHz) |
|---|---|---|---|---|---|---|---|
| Example 1 | ABS plastic | 45° | 2.62 | 0.89 | 0.30 | 80 ± 15 | 12.1 |
| Example 2 | 6061 anodized aluminum | 45° | 2.62 | 0.40 | 0.30 | 60 ± 15 | 43.9 |
| Example 5 | 6061 anodized aluminum | 45° | 2.62 | 0.89 | 0.30 | 30 ± 15 | 93.8 |
| Example 9 | 1018 steel | 45° | 2.62 | 0.40 | 0.30 | 40 ± 15 | 44.7 |

Computer simulations were performed on four different insert designs A, B, C, and D to predict the net shift forward spin compared to a standard steel putter head without any beams. The physical characteristics and the calculated net shift forward spin for each insert are reported below in Table 2.

TABLE 2

| Insert Design | Material | Beam angle (θ) | Beam depth, mm ($D_2$) | Beam thickness, mm ($T_b$) | Gap width, mm ($W_g$) | Net shift forward spin, rpm | Frequency (kHz) |
|---|---|---|---|---|---|---|---|
| A | 6061 anodized aluminum | 45° | 2.62 | 0.50 | 0.30 | 50 | 54.8 |
| B | 6061 anodized aluminum | 45° | 2.62 | 0.70 | 0.30 | 40 | 75.4 |
| C | Urethane | 55° | 2.62 | 0.70 | 0.30 | 200 | 6.1 |
| D | 6061 aluminum | 45° | 10.7 | 0.30 | 0.30 | 110 | 2.2 |

While any of the embodiments described herein can be used, a golf club head having an insert 18 constructed of aluminum, the insert having beams 28 oriented at an angle in the range of about 36 to 46 degrees, the beams having substantially flat end surfaces, a beam thickness of about 0.7 mm, a gap width between adjacent beams of about 0.3 mm, a frequency of oscillation in the range of about 12 kHz to about 95 kHz, and a compliant filler material at least partially filling the gaps has been found to be a suitable implementation of the present technology.

The present invention has been shown in the described embodiments for illustrative purposes only. The present invention may be subject to many modifications and changes without departing from the spirit or essential characteristics thereof. I therefore claim as my invention all such modifications as come within the spirit and scope of the following claims.

I claim:

1. A putter-type golf club head comprising:

a front surface defining a plurality of generally parallel, vertically spaced, deflectable beams each having a generally parallel opposed upper surface and lower surface and extending horizontally across the front surface; and wherein the beams have a substantially constant beam thickness measured between the upper surface and the lower surface;

wherein the beams define fixed first ends connected to a common base and second ends distal from the base that define a striking face for contacting a ball;

wherein the beams extend downwardly from respective fixed ends at an acute angle toward a bottom portion of the club head, wherein the acute angle is defined between the beams and a vertical axis relative to a ground plane when the club head is at address position; and wherein the beams are configured such that when a golf ball impacts the beams, the beams deflect to impart topspin on the golf ball.

2. The golf club head of claim 1, wherein the second end of each beam defines a substantially flat end surface for striking the ball.

3. The golf club head of claim 1, wherein each beam has a frequency of oscillation in the range of about 3 kHz to about 300 kHz.

4. The golf club head of claim 3, wherein each beam has a frequency of oscillation in the range of about 8 kHz to about 150 kHz.

5. The golf club head of claim 4, wherein each beam has a frequency of oscillation in the range of about 12 kHz to about 95 kHz.

6. The golf club head of claim 1, wherein the acute angle is in the range of about 6 to 76 degrees.

7. The golf club head of claim 6, wherein the acute angle is in the range of about 26 to 56 degrees.

8. The golf club head of claim 7, wherein the acute angle is in the range of about 36 to 46 degrees.

9. The golf club head of claim 1, wherein each beam extends horizontally across the front surface from a first end portion adjacent a heel of the club head to a second end portion adjacent a toe of the club head, wherein one or more of the beams have first and second end portions that are fixed relative to the base.

10. A putter-type golf club head comprising:

a base disposed in a front portion of the club head; and a plurality of vertically spaced projections integral to and cantilevered from the base, each projection having a substantially parallel top surface and bottom surface and projecting forwardly and downwardly from the base at an acute angle toward a bottom portion of the club head, wherein the acute angle is defined between each projection and a vertical axis relative to a ground plane when the club head is at address position.

11. The golf club head of claim 10, wherein each projection has an end surface, and wherein the end surfaces of the plurality of projections collectively define a substantially planar striking face configured to strike a golf ball.

12. The golf club head of claim 11, wherein each of the end surfaces is substantially flat.

13. The golf club head of claim 10, wherein the golf club head has a substantially planar front surface and the projections extend horizontally across at least a portion of a width of the front surface.

14. The golf club head of claim 13, wherein each projection has a substantially constant beam thickness.

15. The golf club head of claim 10, wherein each projection has a frequency of oscillation in the range of about 3 kHz to about 300 kHz.

16. The golf club head of claim 15, wherein each projection has a frequency of oscillation in the range of about 8 kHz to about 150 kHz.

17. The golf club head of claim 16, wherein each projection has a frequency of oscillation in the range of about 12 kHz to about 95 kHz.

18. The golf club head of claim 10, wherein the acute angle is in the range of about 6 to 76 degrees.

19. The golf club head of claim 18, wherein the acute angle is in the range of about 26 to 56 degrees.

20. The golf club head of claim 19, wherein the acute angle is in the range of about 36 to 46 degrees.

21. The golf club head of claim 10, wherein each projection has a first end portion adjacent a toe of the club head and a second end portion adjacent a heel of the club head, wherein the first and second end portions of one or more of the projections are fixed relative to the base.

22. The golf club head of claim 21, wherein the first and second end portions of each projection are fixed relative to a peripheral portion of the base, the peripheral portion completely surrounding the projections.

23. The golf club head of claim 10, wherein the base comprises an insert that is disposed in a recess formed in the front portion of the club head.

24. A method for putting a golf ball with a head of a golf putter, the head comprising a plurality of beams extending horizontally across the head, the beams having a substantially constant thickness and being cantilevered from the head and having distal ends that define a striking face for contacting the ball, the method comprising striking the striking face against the ball to cause at least some of the beams to deflect downwardly and rearwardly, and then recoil upwardly and outwardly to impart topspin on the ball.

* * * * *

UNITED STATES PATENT AND TRADEMARK OFFICE

CERTIFICATE OF CORRECTION

PATENT NO. : 7,465,240 B2
APPLICATION NO. : 11/893152
DATED : December 16, 2008
INVENTOR(S) : Nick Frame It is certified that error appears in the above-identified patent and that said Letters Patent is hereby corrected as shown below:

Column 5, line 31, "beams 28 Each" should be --beams 28. Each--

Column 5, line 33, "beams 28 The" should be --beams 28. The--

Column 5, line 40, "insert 18 For" should be --insert 18. For--

Column 5, line 64, "insert 18 In" should be --insert 18. In--

Column 6, line 5, "beams 28 In" should be --beams 28. In--

Column 6, line 31, "insert 18 In" should be --insert 18. In--

Column 7, line 18, "insert 18 Also" should be --insert 18. Also--

Column 7, line 18-19, "insert 18 For" should be --insert 18. For--

Column 7, line 23, "insert 18 Conversely" should be --insert 18. Conversely--

Column 7, line 66-67, "beams 28 Desirably" should be --beams 28. Desirably--

Signed and Sealed this

Fourth Day of May, 2010

David J. Kappos

David J. Kappos
*Director of the United States Patent and Trademark Office*